United States Patent [19]

Watanabe

[11] Patent Number: 4,712,781

[45] Date of Patent: Dec. 15, 1987

[54] OPERATING TABLE FOR MICROSCOPIC LUMBAR LAMINECTOMY SURGERY

[75] Inventor: Robert S. Watanabe, Los Angeles, Calif.

[73] Assignee: Watanabe Orthopedic Systems, Inc., Los Angeles, Calif.

[21] Appl. No.: 861,829

[22] Filed: May 12, 1986

[51] Int. Cl.[4] ..... A61G 13/00

[52] U.S. Cl. ..... 269/322

[58] Field of Search ..... 269/322, 324, 325, 326, 269/328; 378/209

[56] References Cited

U.S. PATENT DOCUMENTS

| | | | |
|---|---|---|---|
| 2,228,793 | 1/1941 | Swofford | 269/322 X |
| 2,577,177 | 12/1951 | Anderson | 269/322 |
| 2,660,495 | 11/1953 | Schwalbe | 269/325 |
| 2,895,775 | 7/1959 | McDonald | 269/325 |
| 3,226,105 | 12/1965 | Weickgenannt et al. | 269/324 |
| 3,493,225 | 2/1970 | Ceraldi | 269/322 |
| 4,372,551 | 2/1983 | Yurdin | 269/322 X |
| 4,391,438 | 7/1983 | Heffington, Jr. | 269/328 |
| 4,527,787 | 7/1985 | Collis, Jr. | 269/322 |

FOREIGN PATENT DOCUMENTS

| | | | |
|---|---|---|---|
| 464924 | 4/1937 | United Kingdom | 269/328 |

*Primary Examiner*—Frederick R. Schmidt
*Assistant Examiner*—Judy J. Hartman
*Attorney, Agent, or Firm*—Keith D. Beecher

[57] ABSTRACT

An operating table intended specifically for microscopic lumbar laminectomy surgery by which the patient is properly positioned for the surgery in a matter of minutes, and which serves to hold the patient in the proper flexed position during the surgical procedure.

4 Claims, 4 Drawing Figures

OPERATING TABLE FOR MICROSCOPIC LUMBAR LAMINECTOMY SURGERY

BACKGROUND OF THE INVENTION

A lumbar laminectomy is a complex and delicate operation, with the possibility of complications such as excessive hemorrhage from the epidural veins, life-threatening injuries to retroperitoneal major blood vessels and tearing of spinal nerves or the dura.

Previous operating procedures for spinal operations called for placing the patient face-down in a horizontal position on a flat surgical table top. In this position, the patient greatest weight is supported primarily by the abdomen on the flat table top. Furthermore, the knees are straight, and the legs extended. However, this has created two problems with which the spinal surgeon has had to contend, and which have an adverse, complicating effect on the surgical procedure. The first problem was that with the patient in the aforesaid position, it was difficult to control and minimize blood loss. As is well known, excessive loss of blood during an operation poses an immediate risk of harm to the patient, due to either the loss of blood itself, or the risk of hepatitis infection concomitant with any blood transfusion. Excessive bleeding at the operation site also obscures the operating field hindering the ability of the surgeon to see his work clearly.

Blood loss during a spinal surgical operation is a function of the degree of intraspinal venous engorgement. That is, whether the blood vessels in the spinal area are full and under pressure, or drained. If the patient is positioned face down on the operating table, as was the standard operating procedure in the prior art, the abdominal area supports a large portion of the patient's weight. This, in turn, causes the viscera to be forced against the spinal column which results in intraspinal engorgement as the blood in the spinal area is retained there and the blood in the visceral area is forced into the spinal area.

Moreover, when the patient is lying face down on the surgical table with his knees straight and his legs extended, the spinal column is under a compressive load. For any operation on the spine, the surgeon prefers to have the spine in a flexed position, that is, in a relaxed state under no load.

Accordingly, it is important for a lumbar laminectomy that the patient be placed with the hips flexed at a right-angle in order to open up the back of the spine and allow for the surgical procedure with a minimum removal of bone from the laminar area. The patient's knees should be flexed to a 90° angle, and the weight of the patient is preferably supported by the iliac crests (hips) and also by the lower portion of the chest. This removes the pressure from the abdomen and decreases bleeding in th spine during the surgical procedure due to the decreased intra-abdominal pressure.

Because of the foregoing, various attachments have been proposed to surgical tables, so that the patient may be placed in a more appropriate position for a spinal operation. Such attachments are described, for example, in Cloward U.S. Pat. No. 4,398,707 and in Wayne U.S. Pat. No. 4,444,381. However, such attachments are subject to certain disadvantages. In some instances, the patient is held, for example, in an upright fetal position with the knees pulled forward to the chest. Although this does flex the spine, the patient is placed in a most uncomfortable position and free breathing is restrictive.

Also, the viscera is forced against the spinal column so that blood loss is accelerated.

In all cases, where such attachments are used in conjunction with a regular operating table, up to an hour of valuable surgical time is lost in placing the patient in proper position on the table. An objective of the present invention is to provide an operating table which is particularly constructed for lumbar laminectomy surgery, and which enables the patient to be placed in the proper position in a matter of minutes.

The operating table of the present invention is constructed to achieve the criteria set forth in the preceding paragraph. The operating table of the invention is a special lumbar surgical table which permits the patient to be positioned in the proper hip and knee 90/90 position in a matter of minutes. This position opens the posterior interlaminal area and minimizes the need for bone dissection of the lamina. The lack of pressure on the abdomen also minimizes bleeding from Batson's vein around the dura. The patient is suspended by the iliac crests and the xyphoid. The patient's head is closer to the anesthesiologist and provides for better monitoring during surgery. There is no pressure nor any acute flexion of the knees so that the venous system is not compromised and there is less danger of a post-operative thrombophlebitis.

In addition, the table of the invention is constructed to permit the C-arm of a standard X-ray machine to be inserted through one side of the table to be directly under and over the patient so as to permit anterior/posterior (AP) as well as lateral X-ray to be taken. In this way, exact coordinates may be provided to the surgeon of the location of the area of the body to which the surgical procedure is to be directed.

A special surgical microscope is attached directly to the table, and this obviates the necessity to move in the large surgical microscope so as to save valuable operating time and space. The patient is placed on the table, and the microscope is then rotated around to the desired position. With proper positioning of the patient, and with the placement of the surgical microscope and the special instruments, the surgical procedure utilizing the table of the present invention can be performed in about half an hour, as compared with two or three hours required for the usual lumbar laminectomy using the prior art equipment.

DETAILED DESCRIPTION OF THE ILLUSTRATED EMBODIMENT

Figure 1:
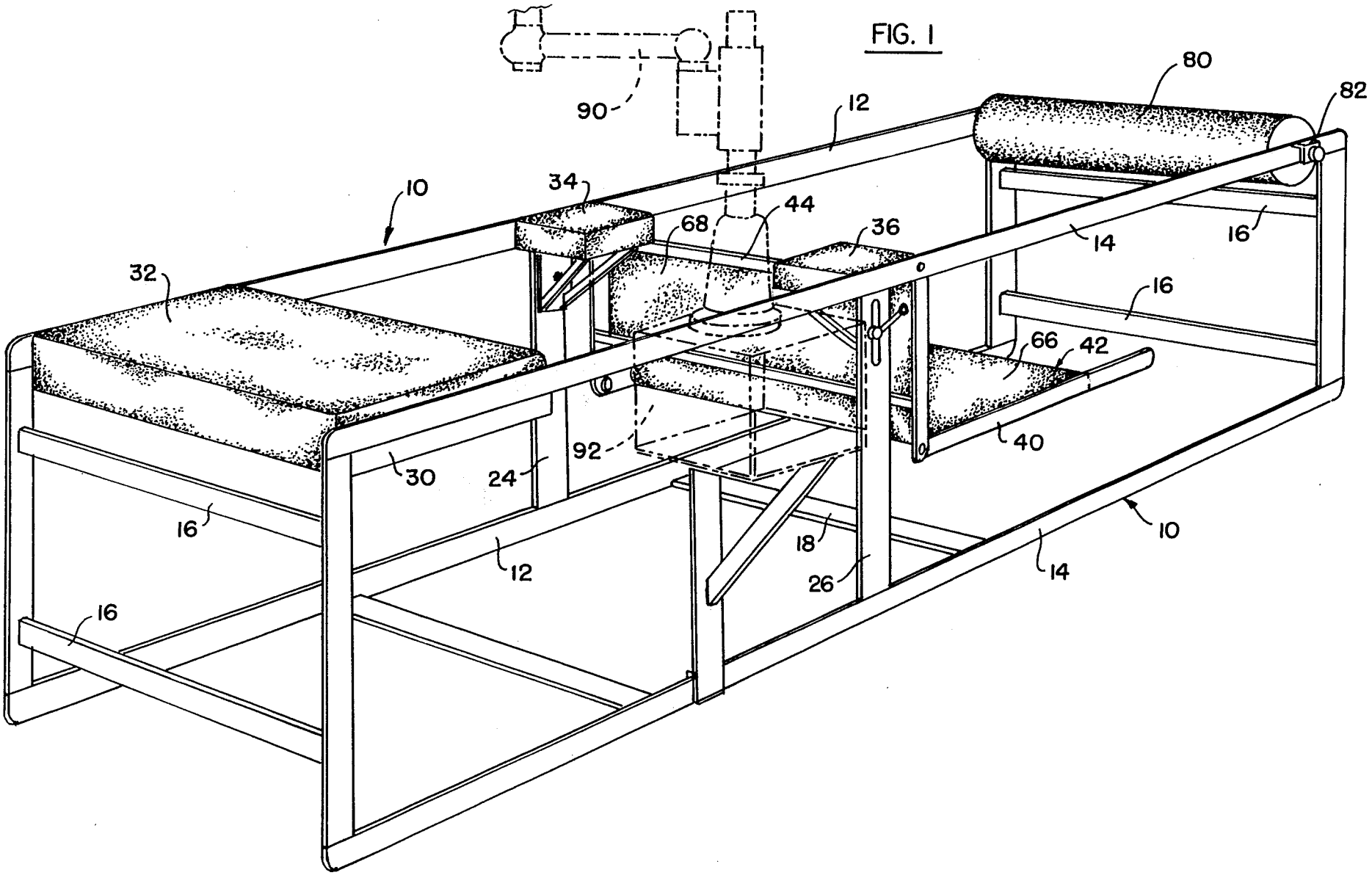
FIG. 1 is a perspective representation of the operating table of the present invention in one of its embodiments, and showing the table in its operating position during the actual surgical procedure.
Figure 2:
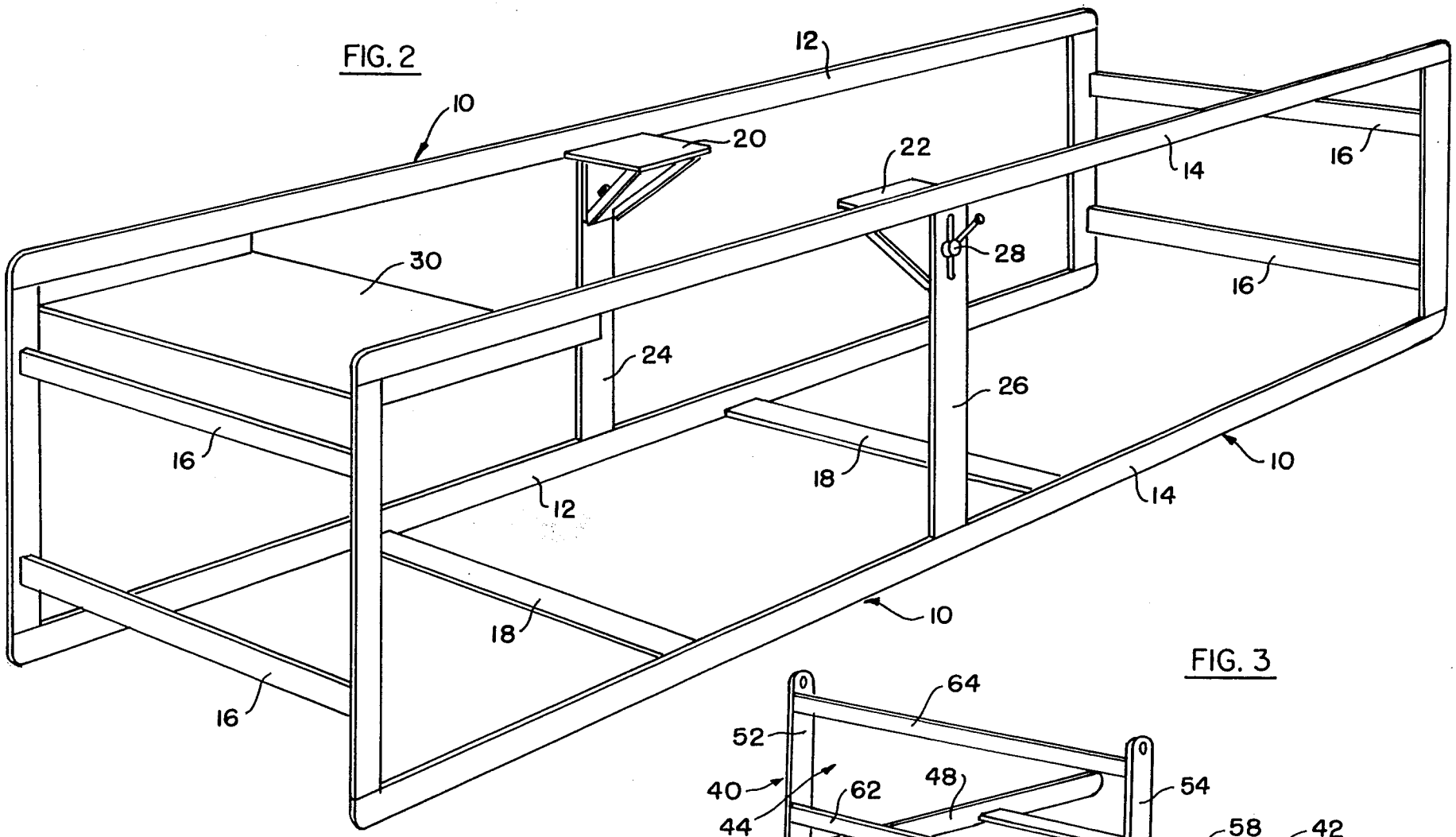
FIG. 2 is a perspective representation of a frame which forms the major portion of the operating table of FIG. 1.

The operating table shown in FIG. 1 includes a frame 10 which is more clearly shown in FIG. 2. The frame 10 has a pair of spaced and parallel sides 12 and 14 which are held in an upright position by members 16 at each end which extend from one side to the other, and by members 18 at the bottom which likewise extend from one side to the other.

The frame also includes a bracket 20 at one side and a bracket 22 at the other side. The brackets are supported on upright members 24 and 26, and each is adjustable, and each can be set to a desired vertical position by a manually operated locking assembly, such as assembly 28.

A shelf 30 is mounted at one end of the frame 10 in FIG. 2. The shelf 30 supports a pad 32, as shown in FIG. 1, and brackets 20 and 22 support pads 34 and 36, as also shown in FIG. 1.

Figure 3:
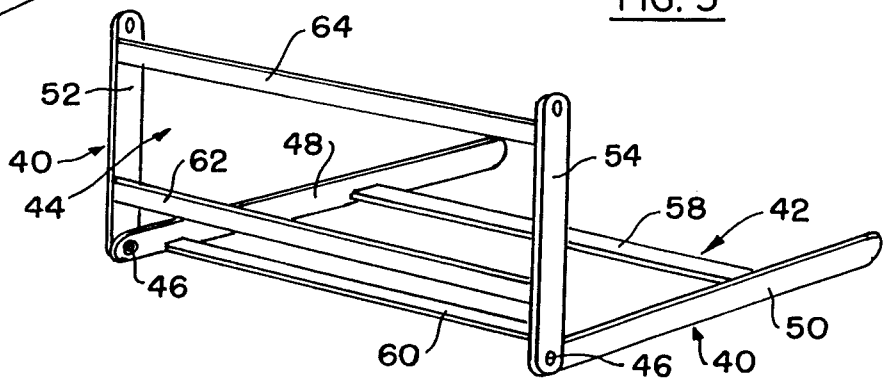
FIG. 3 shows a linkage mounted on the frame of FIG. 2, and which provides a simple and rapid means for bringing the patient into the desired position after the patient has been moved on to the table.

A sub-assembly 40, which is shown in FIGS. 1 and 3 is pivotally coupled to the upper members forming sides 12 and 14 at pivot points designated X in FIGS. 1 and 2. The subassembly 40 includes a first section 42 and a second section 44 which are pivotally coupled to one another by pivot pins 46.

Section 44 (as best shown in FIG. 3) includes two elongated side members 48 and 50, and secton 48 includes two elongated side members 52 and 54. The side members are pivotally coupled by the pivot pins 46. The section 42 also includes elongated cross-members 58 and 60, and section 44 includes elongated cross-members 62 and 64.

A first pad 66 (FIG. 1) is placed on the section 42, and a second pad 68 is placed on the second section 44.

The sub-assembly 40 is moved to the position shown in FIG. 1 during the actual surgical procedure, and it is latched in that position by any appropriate locking assembly, not shown, which may be similar, for example, to locking assembly 28. However, prior to the surgical procedure, the sub-assembly 40 is drawn out so that both sections 40 and 42 are latched in co-planar relationship by the locking assembly to form a flat surface at the top of the table for receiving the patient.

When the sub-assembly 40 is in such a position, the patient is placed on the table and turned on his stomach. The sub-assembly 40 is then lowered to the position shown in FIG. 1 so that the patient is kneeling on the pad 66 with his legs in a horizontal position, and the patient is supported by the pads 34 and 36 engaging his iliac crests, and the patient's body extends across the open area between the pads 34, 36 and the pad 32. The patient's chin and chest rest on the pad 32.

A roller 80 is then moved forwardly across the top rails of sides 12 and 14 to engage the buttocks of the patient so as to hold the patient firmly in position. When the roller 80 is moved to its patient-engaging position, it is locked in that position by a clamp 82, at one end of the roller, and a similar clamp (not shown) at the other end of the roller.

The C-arm of a usual X-ray machine may be moved into the space between the pads 34, 36 and the pad 32 on side 12, so as to be directly over and under the patient, so that appropriate X-rays may be taken, as explained above.

Figure 4:
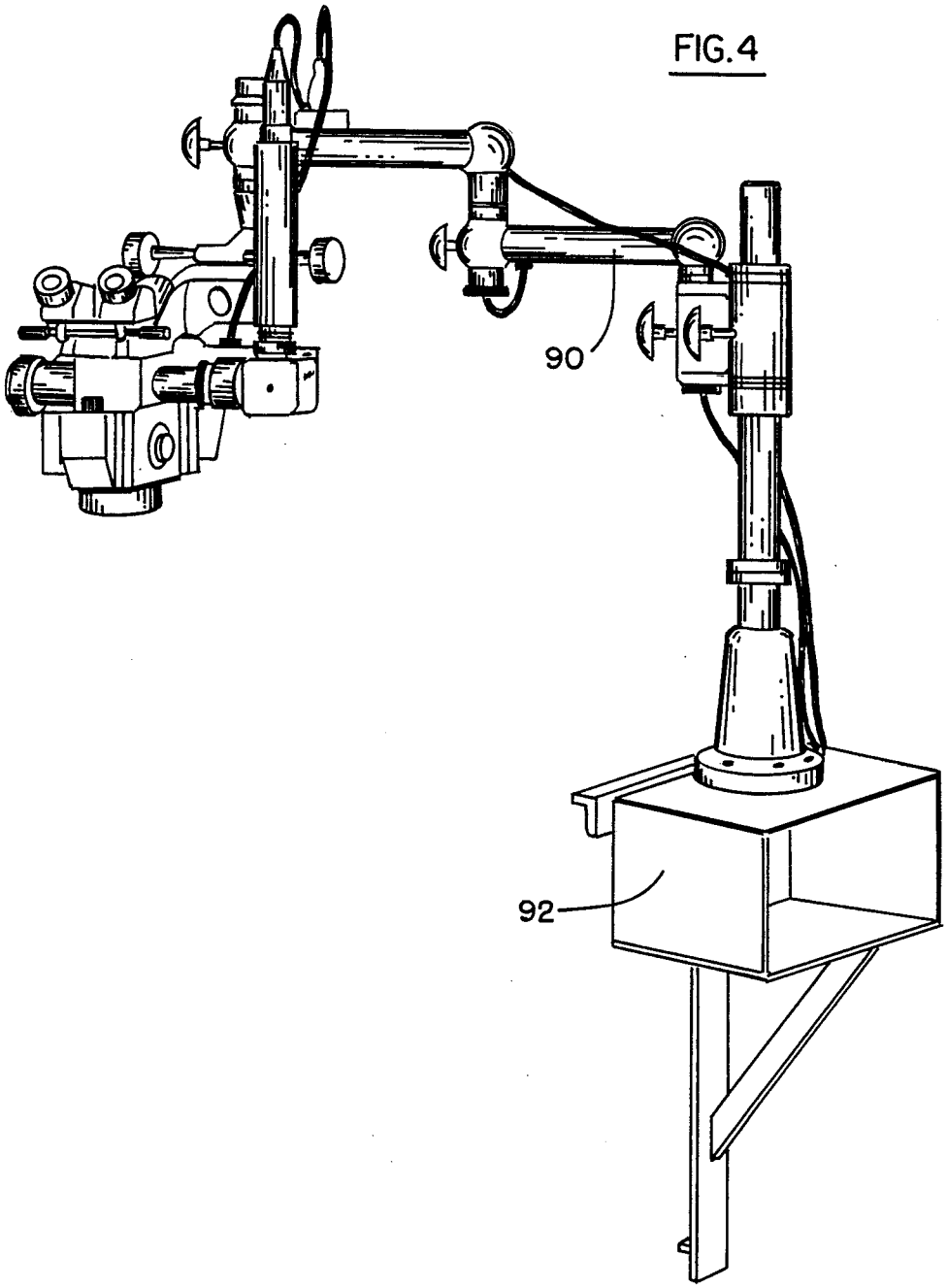
FIG. 4 shows a microscope mounted on a bracket which, in turn, is mounted on the frame of FIG. 2, and which provides an efficient and rapid means for dispensing of extraneous requirements before the surgical procedure can actually get underway.

A portable microscope 90, as shown in FIG. 4, may be mounted on a stand 92 which, in turn, is mounted on the side 14 of the frame in any appropriate manner. The microscope, accordingly, is attached to the surgical table and remains out of the way of the surgical assistants and nurses. Adjustments of the microscope for various vertical heights be made without difficulty. Also the microscope can be easily moved horizontally to convenient positions during surgery. All of the microscope controls are within easy reach of the surgeon and assistants. The microscope is extremely sturdy and stable due to the attachment to the surgical table. The miscroscope may be dismantled and stored when not in use, and it is readily portable.

The invention provides, therefore, an operating table which is constructed especially for microscopic lumbar laminectomy surgery, and which enables the patient to be positioned quickly and efficiently, and which also serves to hold the patient in an ideal position while the surgery is being performed.

It will be appreciated that while a particular embodiment of the invention has been shown and described, modifications may be made. It is intended in the claims to cover all modifications which come within the true spirit and scope of the invention.

I claim:

1. An operating table for microscopic lumbar laminectomy, and the like, comprising: a frame-like structure including first and second elongated spaced and parallel side members defining a rectangular-shaped open top; a shelf-like member mounted on said side members at one end of said open top for supporting the chin and chest of a patient lying face down on the table; a pair of brackets mounted on the frame-like structure adjacent to said open top, said brackets being spaced laterally from one another and spaced longitudinally from said shelf-like member for supporting the iliac crests, means for vertically adjusting said brackets on said first and second side members, respectively of the patient so that the weight of the patient is supported by the iliac crests and by the lower part of the chest; and support means pivotally coupled to said side members at the open top of said frame structure on the remote side of said brackets from said shelf-like member and movable to a first position to provide a flat surface at said open top of said frame-like structure for receiving a patient on the table, and to a second position to provide a support for the patient in a kneeling position, said support means including first and second panels which extend across the open top of said frame-like structure in co-planar relationship with one another when the support means is in said first position, and in which said first panel assumes a vertical position and said second panel assumes a horizontal position displaced down from the open top of said frame-like structure when said support means is in said second position.

2. The operating table defined in claim 1, and which includes a roller-like member mounted on said side members and positioned on said frame-like structure at the other end thereof from said shelf-like member and movable along said side members to engage the buttocks of the patient when said support means is in said second position.

3. The operating table defined in claim 1, in which at least one side of said frame-like structure between said shelf-like member and said brackets is open to permit access to an X-ray machine.

4. The operating table defined in claim 1, and which includes a portable microscope removably mounted on said frame-like structure.

* * * * *